US005705473A

United States Patent [19]

Kuroda et al.

[11] Patent Number: 5,705,473

[45] Date of Patent: Jan. 6, 1998

[54] NONIONIC POWDERY DETERGENT COMPOSITION CONTAINING AN ALUMINOSILICATE BUILDER AND A SILICON-CONTAINING OIL ABSORBING CARRIER

[75] Inventors: Mutsumi Kuroda, Wakayama; Hiroshi Ohtsuka, Tochigi; Hiroyuki Yamashita, Wakayama; Mikio Sakaguchi, Wakayama; Hiroyuki Kondo, Wakayama; Kouichi Hatano, Wakayama; Fumio Sai, Tochigi, all of Japan

[73] Assignee: KAO Corporation, Tokyo, Japan

[21] Appl. No.: 232,468

[22] Filed: Apr. 22, 1994

Related U.S. Application Data

[62] Division of Ser. No. 762,368, Sep. 19, 1991, abandoned.

[30] Foreign Application Priority Data

| | | | |
|---|---|---|---|
| Sep. 28, 1990 | [JP] | Japan | 2-259711 |
| Oct. 16, 1990 | [JP] | Japan | 2-278612 |
| Dec. 21, 1990 | [JP] | Japan | 2-404946 |

[51] Int. Cl.[6] ..... C11D 10/02; C11D 1/66; C11D 3/12

[52] U.S. Cl. ..... 510/441; 510/293; 510/444; 510/466; 510/507; 510/511

[58] Field of Search ..... 352/90, 140, 174.13, 352/174.25, 174.21, 438, 441; 510/444, 466, 507, 511, 293

[56] References Cited

U.S. PATENT DOCUMENTS

| | | | |
|---|---|---|---|
| 3,671,294 | 6/1972 | Hopermann | 252/90 |
| 3,915,878 | 10/1975 | Yurko et al. | 252/99 |
| 4,136,051 | 1/1979 | Saran et al. | 252/91 |
| 4,260,651 | 4/1981 | Wixon | 427/214 |
| 4,405,484 | 9/1983 | Miyazaki | 252/174.25 |
| 4,406,808 | 9/1983 | Gangwisch | 252/91 |
| 4,741,856 | 5/1988 | Taylor | 252/174 |
| 4,869,843 | 9/1989 | Saito | 252/135 |
| 4,970,017 | 11/1990 | Nakamura | 252/174.13 |
| 5,024,778 | 6/1991 | Grecsek | 252/140 |
| 5,080,820 | 1/1992 | Grecsek | 252/140 |
| 5,578,651 | 11/1996 | Sakamoto et al. | 510/349 |

FOREIGN PATENT DOCUMENTS

| | | |
|---|---|---|
| 0050894 | 5/1982 | European Pat. Off. . |
| 0425804 | 5/1991 | European Pat. Off. . |
| 2500474 | 8/1982 | France . |
| 2500475 | 8/1982 | France . |
| 0119813 | 9/1975 | Japan . |
| 5141708 | 4/1976 | Japan . |
| 6189300 | 5/1986 | Japan . |
| 1474856 | 5/1977 | United Kingdom . |

OTHER PUBLICATIONS

World Patents Index Latest, AN 86–158046 of Japanese Publication 61–089300 (1986).

*Primary Examiner*—Margaret Einsmann
*Attorney, Agent, or Firm*—Birch, Stewart, Kolasch & Birch, LLP

[57] ABSTRACT

To provide a nonionic powdery detergent free from oozing of a liquid nonionic surfactant at ambient temperature and having excellent powder fluidity and non-caking properties and a solubility which is not deteriorated with time.

The nonionic powdery detergent composition comprises (a) 12 to 35% by weight of a nonionic surfactant having a melting point of not higher than 40° C. and an HLB in the range of 9.0 to 16.0, (b) 10 to 60% by weight of a crystalline aluminosilicate and (c) 5 to 20% by weight of an amorphous oil-absorbing carrier containing at least 30% by weight of silicon (in terms of $SiO_2$) versus the weight of said carrier in an anhydrous state and having an oil-absorbing capacity of at least 80 ml/100 g, said carrier giving a dispersion with a pH of at least 9 or being soluble in a 2% aqueous NaOH solution in an amount of 0.5 g or below.

16 Claims, No Drawings

NONIONIC POWDERY DETERGENT COMPOSITION CONTAINING AN ALUMINOSILICATE BUILDER AND A SILICON-CONTAINING OIL ABSORBING CARRIER

This application is a divisional of application Ser. No. 07/762,368 filed on Sep. 19, 1991, now abandoned.

FIELD OF INDUSTRIAL APPLICATION

The present invention relates to a powdery detergent composition comprising a nonionic surfactant as the main base. In particular, the present invention relates to a powdery detergent composition which is free from oozing of the liquid nonionic surfactant at ambient temperature and has excellent flow and non-caking properties of the powder and a solubility which is not deteriorated during storage.

PRIOR ART

Nonionic surfactants are regarded as an important detergenting surfactant, since they have an excellent resistance to hard water, marked deterging and dirt-dispersing powers, and quite excellent biodegradability.

However, most of the nonionic surfactants usually used for detergents are in liquid form at ambient temperature. Therefore they are problematic in that when incorporated in a large amount into a powdery detergent, they will gradually ooze out with the lapse of time to soak into the inner face of a paper container, seriously reducing the fluidity of the powdery detergent, and causing caking and consequent solidification of the detergent, thereby seriously impairing the commercial value.

Japanese Patent Laid-Open No. 119813/1975 discloses a fluid detergent comprising 30 to 100% of a premix (which may contain 4% or less of highly dispersible silicic acid) prepared by finely distributing a nonionic surfactant on zeolite or a mixture of zeolite with an inorganic peroxide which generates hydrogen peroxide in water and 0 to 70% of a spray-dried detergent. Japanese Patent Laid-Open No. 89300/1986 discloses a nonionic surfactant-containing granular detergent having a high fluidity and resistant to caking, prepared by mixing water-soluble granules with silica powder, spraying a nonionic surfactant thereon, adding zeolite powder thereto, granulating them, and mixing the granules with an anionic surfactant-containing granular detergent. This technique is, however, one mainly based on the investigations of detergent additives comprising a nonionic surfactant which is to be incorporated into a spray-dried detergent comprising an anionic surfactant as the main detergent base. No sufficient investigations have been made on the detergent of the present invention comprising a nonionic surfactant as the main detergent base.

Japanese Patent Laid-Open No. 41708/1976 discloses a free-flow detergent composition comprising a porous aggregate of a synthetic amorphous silica derivative and a nonionic surfactant.

It is known that a siliceous substance can be used for improving the fluidity of a nonionic surfactant-containing detergent as shown by the above-described examples.

However, when a siliceous substance is incorporated into a zeolite-containing detergent, the solubility is deteriorated with time under humid conditions and, therefore, a further improvement is necessitated.

SUMMARY OF THE INVENTION

After intensive investigations of a zeolite-containing detergent which comprises a nonionic surfactant as the main detergent base made under these circumstances, the inventors have found that when an oil-absorbing carrier having specified properties is used, the prevention of oozing of the liquid nonionic surfactant and fluid and non-caking properties of the powder are improved and the solubility is not deteriorated even by storage under conditions of high-humidity. The present invention has been completed on the basis of this finding.

Thus the present invention provides a nonionic powdery detergent composition comprising the following components (a), (b) and (c):

(a) 12 to 35% by weight of a nonionic surfactant having a melting point of not higher than 40° C. and an HLB in the range of 9.0 to 16.0.

(b) 10 to 60% by weight of a crystalline aluminosilicate and (c) 5 to 20% by weight of an oil-absorbing carrier containing at least 30% by weight of silicon (in terms of $SiO_2$) versus the weight of said carrier in an anhydrous state and having an oil-absorbing capacity of at least 80 ml/100 g, said carrier giving a dispersion with a pH of at least 9 or being soluble in a 2% aqueous NaOH solution in an amount of 0.5 g or less.

In other words, the invention provides a nonionic powder detergent composition comprising 12 to 35 wt. % of (a) a nonionic surfactant having a melting point of not higher than 40° C. and an HLB value of 9.0 to 16.0, 10 to 60 wt. % of (b) a crystalline aluminosilicate and 5 to 20 wt. % of (c) an oil-absorbing carrier (c-1) containing at least 30 wt. % of silicon in terms of $SiO_2$, (c-2) having an oil-absorbing capacity of at least 80 ml/100 g, said carrier (c-3) giving a dispersion with a pH value of at least 9 or being soluble in a 2% aqueous NaOH solution in an amount of 0. 5 g or less.

The invention includes the following embodiments: (1) the composition as defined above, which comprises 12 to 35 wt. % of (a), 20 to 60 wt. % of (b) and 5 to 20 wt. % of (c) an oil-absorbing carrier (c-1) containing at least 40 wt/% of silicon in terms of $SiO_2$, (c-2) having an oil-absorbing capacity of at least 150 ml/100 g, said carrier (c-3) giving a dispersion with a pH value of at least 9; (2) the composition as defined above, which comprises 12 to 35 wt. % of (a), 20 to 60 wt. % of (b) and 5 to 30 wt. % of (c) an oil-absorbing carrier (c-1) containing at least 40 wt. % of silicon in terms of $SiO_2$, (c-2) having an oil-absorbing capacity of at least 80 cc/100 g, said carrier (c-3) being soluble in a 2% NaOH solution in an amount of 0.5 g or less; and (3) the composition as defined above, which comprises 12 to 35 wt. % of (a), 20 to 60 wt. % of (b) and 5 to 30 wt. % of (c) a non-crystalline aluminosilicate (c-2) having an oil-absorbing capacity of at least 200 cc/100 g, said carrier (c-3) being soluble in a 2% aqueous NaOH solution in an amount of 0.05 g or less.

The invention moreover provides a process for producing a nonionic powder detergent composition, which comprises the steps of mixing (b) a crystalline aluminosilicate with (c) an oil-absorbing carrier, while adding to or spraying onto the mixture (a) a liquid nonionic surfactant gradually to obtain a homogeneous mixture of (a), (b) and (c) and then adding to the mixture further crystalline aluminosilicate to obtain a powder detergent composition. As for optional ingredients, sodium carbonate may be added in the first step. A perfume and an enzyme may be added in the second step.

The nonionic surfactant (a) used in the present invention is preferably one having a melting point of not higher than 40° C. and an HLB value in the range of 9.0 to 16.0, and more preferably 9.0 to 14.0, from the viewpoints of the removal of dirt as well as foaming and rinsing properties. The term HLB as used herein refers to a value calculated by a method described in J. T. Davies and E. K. Rideal, "Interfacial Phenomena" (Academic Press, New York, 1963), pages 371 to 383.

Examples of the component (a) include polyoxyethylene alkyl ethers, polyoxyethylene alkylphenyl ethers, polyoxyethylene sorbitan fatty acid esters, polyoxyethylene sorbitol fatty acid esters, polyethylene glycol fatty acid esters, polyoxyethylene/polyoxypropylene alkyl ethers, polyoxyethylene castor oil, polyoxyethylene-hardened castor oil, polyoxyethylene alkylamines, glycerol fatty acid esters, higher fatty acid alkanolamides, alkyl glycosides and alkylamine oxides.

Among them, preferred main nonionic surfactants are polyoxyethylene alkyl ethers of straight-chain or branched, primary or secondary alcohols having 10 to 20, preferably 10 to 15 and more preferably 12 to 14 carbon atoms, having 5 to 15 mol, preferably 6 to 12 mol, and more preferably 6 to 10 mol, on average of ethylene oxide added thereto.

The polyoxyethylene alkyl ethers usually contain a large amount of alkyl ethers having a low molar number of ethylene oxide added thereto. Those comprising 35% by weight or less, or preferably 25% by weight or less, of 0 to 3 mol of ethylene oxide added are preferred.

The component (a) is contained in an amount of 12 to 35% by weight, preferably 15 to 30% by weight, based on the whole composition.

The crystalline aluminosilicates (zeolites) used as the component (b) in the present invention are those represented by the following formula (3):

$$x(M_2O).Al_2O_3.y(SiO_2).w(H_2O) \quad (3)$$

wherein M represents an alkali metal atom and x, y and w each represent a molar number of the respective components which are generally as follows: $0.7 \leqq x \leqq 1.5$, $0.8 \leqq y \leqq 6$ and w is an arbitrary positive number.

Among them, those of the following general formula (4):

$$Na_2O.Al_2O_3.n(SiO_2).w(H_2O) \quad (4)$$

wherein E represents a number of 1.8 to 3.0 and w represents a number of 1 to 6, are preferred. The crystalline aluminosilicates (zeolites) preferably used are synthetic zeolites having an average primary particle diameter of 0.1 to 10 μ typified by zeolite A and zeolite X. Zeolite is incorporated in the form of a powder and/or a dry particle of zeolite aggregate obtained by drying a zeolite slurry.

The component (b) is incorporated into the composition in an amount of 10 to 60% by weight, preferably 20 to 60% by weight and more preferably 30 to 50% by weight based on the whole composition.

The oil-absorbing carriers used as the component (c) in the present invention include amorphous silica and aluminosilicates containing at least 30% by weight, preferably at least 40% by weight and more preferably at least 70% by weight (in terms of $SiO_2$) versus the weight of said carrier in an anhydrous state, of silicon, having an oil-absorbing capacity of at least 80 ml/100 g, preferably at least 150 ml/100 g and more preferably at least 200 ml/100 g, and giving a dispersion with a pH of at least 9 (test method: JIS K 6220). Amorphous silica and aluminosilicates having an average particle diameter of up to around 200 μ are available on the market, and the carrier of the present invention may be selected therefrom. Examples of such an oil-absorbing amorphous silica include Tokusil AL-1 (mfd. by Tokuyama Soda Co., Ltd.), Nipsil NA (mfd. by Nippon Silica Ind.), Carplex #100 (mfd. by Shionogi Pharmacy) and Sipernat D10 (Degussa AG.). Examples of the oil-absorbing amorphous aluminosilicate include an oil-absorbing carrier available on the market under a trade name of Tixolex 25 (Kofran Chemical). The oil-absorbing carriers satisfying the above-described conditions are also found in clayey substances and they include sodium mordenite HSZ-640 NAA (mfd. by Tosoh Corp.).

The oil-absorbing carriers illustrated above have scarcely any cation exchange capacity. Cation-exchanging oil-absorbing carriers are advantageous, since they act also as a builder for detergent. Examples of the oil-absorbing carriers having a high oil-absorbency and a high cation exchange capacity include oil-absorbing amorphous aluminosilicates of the following general formula (1):

$$a(M_2O).Al_2O_3.b(SiO_2).c(H_2O) \quad (1)$$

wherein M represents an alkali metal atom and a, b and c each represent the molar number of the respective components which are usually as follows: $0.7 \leqq a \leqq 2.0$, $0.8 \leqq b < 4$ and c is an arbitrary positive number.

Particularly preferred are those of the following general formula (2):

$$Na_2O.Al_2O_3.m(SiO_2).c(H_2O) \quad (2)$$

wherein m represents a number of 1.8 to 3.2 and c represents a number of 1 to 6.

The amorphous aluminosilicates having a high oil absorbency and a high ion-exchange capacity usable in the present invention are prepared by adding an aqueous solution of a low-alkali alkali metal aluminate having a $M_2O/Al_2O_3$ (M being an alkali metal) molar ratio of 1.0 to 2.0 and a $H_2O/M_2O$ molar ratio of 6.0 to 500 to an aqueous solution of an alkali metal silicate having a $SiO_2/M_2O$ molar ratio of 1.0 to 4.0 and a $H_2O/M_2O$ molar ratio of 12 to 200 under vigorous stirring at 15° to 60° C., preferably 30° to 50° C. Alternatively, the aqueous solution of an alkali metal silicate may be added to the aqueous solution of an alkali metal aluminate.

The intended product can be advantageously obtained by heat-treating a white slurry of precipitates thus formed at 70° to 100° C., preferably 90° to 100° C., for 10 min to 10 h, preferably not longer than 5 h, followed by filtration, washing and drying. Thus the oil-absorbing amorphous aluminosilicate carrier having an ion-exchange capacity of at least 100 $CaCO_3$ mg/g and an oil-absorbing capacity of at least 200 ml/100 g can be easily obtained (refer to Japanese Patent Laid-Open Nos. 191417/1987 and 191419/1987).

When an oil-absorbing carrier comprising at least 30% by weight, particularly at least 70% by weight, of $SiO_2$ versus the weight of said carrier in an anhydrous state and giving a dispersion with a pH of below 9.0 is stored at a particularly high humidity, the dispersibility and solubility of the detergent are seriously deteriorated. Supposedly this is because the oil-absorbing carrier containing $SiO_2$ and giving a dispersion with a pH of below 9.0 is dissolved in an alkaline free water formed during storage of the detergent to form sodium silicate having a high $SiO_2$ content, which acts as the binder for zeolite to inhibit the dispersion and solubility of the detergent.

The pH of the dispersion of the oil-absorbing carrier is determined according to JIS K 6220. In particular, about 5 g of the sample is weighed into a hard Erlenmeyer flask and 100 ml of water free from carbon dioxide is added thereto.

The flask is stoppered and shaken for 5 min. The liquid thus obtained is used as a test solution to determine the pH by a glass electrode method (JIS Z 8802-7.2.3).

By selecting an oil-absorbing carrier which gives a dispersion with a pH of at least 9.0, a zeolite-containing nonionic powdery detergent composition with a solubility which is not deteriorated during the storage can be obtained.

When the detergent has a quite high alkalinity or the storage conditions are quite severe, it is preferable to select an oil-absorbing carrier satisfying a severer condition such that the soluble amount in a 2% aqueous NaOH solution is 0.5 g or less.

More specifically, it is preferable to select such an oil-absorbing carrier that when 10 g thereof is dispersed in 100 ml of a 2% aqueous NaOH solution, the dispersion is stirred for 16 h while the temperature is kept at 25° C., and $SiO_2$ in the filtrate is subjected to colorimetric determination [as for the colorimetric determination, refer to Yukagaku, Vol. 25, p. 156 (1976)], the solubility thereof is 0.5 g or less. The oil-absorbing carriers satisfying this condition include sodium mordenite HSZ-640 NAA mfd. by Tosoh Corp. and some of the amorphous aluminosilicates of the above general formula (2).

On the other hand, the oil-absorbing carriers include also one wherein the pH of a 5% dispersion thereof is below 9.0 but the solubility thereof in a 2% aqueous NaOH solution is 0.5 g or below. Such an oil-absorbing carrier is also within the scope of the present invention. For example, Perlite 4159 which is a clayey substance mfd. by Dicalite Orient Go., Ltd. has such properties and is usable as the oil-absorbing carrier in the present invention.

The oil-absorbing carrier (c) is incorporated in an amount of 5 to 20% by weight, preferably 5 to 10% by weight, based on the whole composition.

The composition of the present invention preferably contains sodium carbonate as an alkali. Sodium carbonate includes heavy sodium carbonate (heavy ash) and light sodium carbonate (light ash). It has an average particle diameter of 10 to 2000 μ, preferably 100 to 1000 μ. Sodium carbonate is incorporated in an amount of 5 to 35% by weight, preferably 5 to 25% by weight, based on the whole composition.

The powder properties of the composition of the present invention during storage over a long period of time are further improved by incorporating 1 to 5% by weight, preferably 1 to 3% by weight, of polyethylene glycol having a molecular weight of 4000 to 20000 thereinto.

The powdery detergent composition of the present invention may contain, in addition to the above-described components, an alkali such as sodium silicate, an inorganic electrolyte such as sodium sulfate, an organic chelating agent such as an aminopolyacetate or polyacrylate, an antiredeposition agent such as carboxymethylcellulose, an enzyme such as protease, lipase, cellulase or amylase, an antioxidant, a fluorescent dye, a blueing agent, a flavor, etc., which are usually incorporated into detergents. The amount of sodium silicate incorporated is preferably not more than 5%, still preferably not more than 1% by weight, since it might interact with zeolite to increase the amount of water-insoluble matter to thereby pose a problem of adhesion to the cloth. When the composition is a bleach-detergent composition, a bleaching agent such as sodium percarbonate or sodium perborate mono- or tetrahydrate, a stabilizer for a peroxide, such as magnesium silicate, and a bleaching activator can be incorporated into the composition. When the composition is a softening detergent, a small amount of a cationic surfactant may be incorporated thereinto and the composition is for cleaning muddy dirt, a small amount of an anionic surfactant may be incorporated thereinto.

The nonionic powdery detergent composition of the present invention can be easily produced by mixing a crystalline aluminosilicate, an oil-absorbing carrier and, if necessary, a powdery component such as sodium carbonate together, while a liquid nonionic surfactant is gradually added thereto or sprayed thereon to obtain a homogeneous mixture, and then mixing it with minor components such as perfume or enzyme, a crystalline aluminosilicate powder as the surface-modifying agent, a bleaching agent used when the composition is a bleach-detergent, etc. When the particle diameter of the powdery detergent is increased (200 to 1000 μ, preferably 300 to 700 μ), the properties of the powder during the storage for a long period of time are further improved.

The nonionic powdery detergent composition of the present invention thus produced has a bulk density of about, 0.6 to 1.2 g/ml, preferably 0.7 to 0.9 g/ml.

The nonionic powdery detergent composition of the present invention is desirably packed in a converted paper container, of which the inner walls are laminated with a polymer, to obtain a nonionic powdery detergent product. The polymers used for the lamination are preferably ones having a solubility parameter value of 7.5 to 11.5 $[cal/cm^3]^{1/2}$, preferably 7.5 to 10.0 $[cal/cm^3]^{1/2}$ and more preferably 7.5 to 9.0 $[cal/cm^3]^{1/2}$. The solubility parameter value of the polymer herein indicates a value defined in R. F. Fedors, "Polymer Engineering and Science", 14. 147 (1974).

The polymers used for the lamination are ones having a solubility parameter value lower than the HLB value of the nonionic surfactant of the powdery detergent to be packed. Particularly preferred polymers satisfying these conditions are polyethylene and polypropylene. When the solubility parameter value of the polymer is equal to or higher than the HLB value of the nonionic surfactant or when it exceeds 11.5, the powdery detergent tends to firmly adhere to the wall of the container.

The lamination can be conducted by any conventional process. It is preferred, however, to apply the polymer to the surface of a paper having a basis weight of 400 to 700 $g/m^2$ to form a polymer film having a thickness of 5 to 40 μ, preferably 10 to 40 μ. The shape of the container is preferably one having only little bonded parts.

EXAMPLES

The following Examples will further illustrate the present invention, which by no means limit the invention.

Example 1

3 % by weight of tallow soap, zeolite 4A in an amount as specified in Table 2, an oil-absorbing carrier having properties as specified in Table 1 (wherein the pH of 5% dispersion was determined according to JIS K 6220) in an amount as specified in Table 2, the balance of sodium carbonate, 3% by weight of sodium polyacrylate and 0.5% by weight of a fluorescent dye were placed in a batch kneader (Bench Kneader PNV-1 of Irie Shokai). A liquid nonionic surfactant was gradually introduced thereinto and then 2% by weight of molten polyethylene glycol having an average molecular weight of 12000 was added thereto to obtain a powdery detergent base having an average particle diameter of 385 μ. Further 0.54 by weight of an enzyme, 0.3% by weight of a perfume and 5% by weight of zeolite 4A were added thereto and mixed together to obtain a final detergent product having a composition as specified in Table 2.

The oozing, powder fluidity, caking, and solubility change of the detergent upon storage were tested by the following methods.

The results are given in Table 2.

Evaluation method

1. Oozing test:

An open box having a length of 10. 2 cm, a width of 6.2 cm and a height of 4 cm was made from a coated board (640 g/m$^2$) and the four corners thereof were fixed with a stapler. 100 g of the sample was placed in the box. An acrylic resin plate (15 g) and a lead plate (250 g) (total weight: 265 g) were placed thereon, and they were left to stand in a thermohygrostatic chamber at 30° C. and 80% RH for 7 days. The extent of oozing into the coated board after the test was determined based on the following criteria:

A: no trace of oozing was found on the inner wall of the box,

B: the inner wall of the box was slightly wet,

C: the whole inner wall of the box was wet,

D: a part of the outer wall of the box was also wet, and

E: at least ⅓ of the outer wall of the box was wet.

2. Test of powder fluidity:

The powder fluidity was determined according to "Flow Rate" of "Flow Rate of Metal Powders" described in ASTM: B213-48 by using a stand and a funnel specified in JIS K 3362 "Testing Methods for Synthetic Detergent".

3. Caking test:

(1) An open box having a length of 10.2 cm, a width of 6.2 cm and a height of 4 cm was made from a filter paper (Toyo Filter Paper No. 2) and the four corners thereof were fixed with a stapler.

(2) 50 g of the sample was placed in the box. An acrylic resin plate (15 g) and a lead plate or iron plate (250 g) (total weight: 265 g) were placed thereon.

(3) They were left to stand in a thermohygrostatic chamber at 30° C. and 80% humidity for 7 days and the state of caking was judged.

Judgement:

The state of caking was judged in terms of the following undersize weight percent:

Undersize weight percent

After the test, the sample was gently poured on a metal gauze (or sieve of 5 mm×5 mm mesh) and the powder which passed through it was weighed to calculate the undersize weight percent based on the sample after the test.

Numerical formula 1

$$\text{Undersize weight percent (\%)} = \frac{\text{weight (g) of the powder which has passed}}{\text{weight (g) of the whole sample}} \times 100$$

4. Test of solubility change upon storage:

The powdery detergent was placed in a Petri dish and left to stand at 30° C. and 70% RH for 3 days and 0.83 g of the detergent was taken as the sample, which was added to 1 l of city water at 10° C. and the solution was stirred with a magnetic stirrer for 10 min and filtered through a 200-mesh metal gauze. After drying, the filtration residue rate (%) was determined.

TABLE 1

| Kind | pH of 5% dispersion | Amount of absorbed oil | $SiO_2$ content (wt. %) |
|---|---|---|---|
| TOKUSIL AL-1 ® (Tokuyama Soda Co., Ltd.) | 9.2 | 255 | 94 |
| NIPSIL NA ® (Nippon Silica Ind.) | 10.2 | 245 | 93 |
| TIXOLEX 25 ® (Kofran Chemical) | 9.8 | 235 | 72 |
| CARPLEX #100 ® (Shionogi Pharmacy) | 10.4 | 230 | 93 |
| SIPERNAT D 10 ® (Degussa AG) | 10.3 | 240 | 98 |
| TOKUSIL NR ® (Tokuyama Soda Co., Ltd.) | 5.8 | 280 | 94 |
| FLORITE RN ® (Tokuyama Soda Co., Ltd.) | 8.1 | 380 | 61 |
| TIXOSIL 38 ® (Kofran Chemical) | 6.5 | 280 | 90 |

TABLE 2

| | | Invention product | | | | | Comparative | | | Invention product | | Comparative |
|---|---|---|---|---|---|---|---|---|---|---|---|---|
| | Composition (wt. %) | 1 | 2 | 3 | 4 | 5 | 6 | 7 | 8 | 9 | 10 | 11 |
| Component (a) | polyoxyethylene dodecyl ether (EOp = 8, m.p. 15° C., HLB 10.14) | 24 | 24 | 24 | 24 | 24 | 24 | 24 | 24 | | 15 | 15 |
| | primary synthetic alcohol ethoxylate ($C_{12-14}$, EOp = 10, m.p. 22° C., HLB 11.28) | | | | | | | | | 20 | | |
| Component (b) | Zeolite 4A (average particle diameter 3μ) | 30 | 30 | 30 | 30 | 30 | 30 | 30 | 30 | 45 | 55 | 55 |
| Component (c) | TOKUSIL AL-1 | 10 | | | | | | | | 5 | | 3 |
| | NIPSIL NA ® | | 10.5 | | | | | | | | | |
| | TIXOLEX 25 ® | | | 10.5 | | | | | | | 10 | |
| | CARPLEX #100 ® | | | | 11.0 | | | | | | | |
| | SIPERNAT D10 ® | | | | | 10.5 | | | | | | |
| | TOKUSIL NR ® | | | | | | 10.0 | | | | | |
| | FLORITE RN ® | | | | | | | 7.5 | | | | |

TABLE 2-continued

| | Composition (wt. %) | Invention product 1 | 2 | 3 | 4 | 5 | Comparative 6 | 7 | 8 | Invention product 9 | 10 | Comparative 11 |
|---|---|---|---|---|---|---|---|---|---|---|---|---|
| | TIXOSIL 38 ® | | | | | | | | 10.5 | | | |
| Evaluation results | oozing | A–B | A–B | A–B | A–B | A–B | A–B | A–B | A–B | A–B | A–B | B |
| | fluidity (sec) | 8.0 | 8.1 | 8.0 | 8.0 | 8.0 | 8.1 | 8.1 | 8.1 | 8.2 | 8.1 | 9.0 |
| | caking (undersize wt. %) | 100 | 100 | 100 | 100 | 100 | 100 | 100 | 100 | 100 | 100 | 60 |
| | solubility change upon storage [filtration residue (%)] | 0.6 | 0.7 | 0.7 | 0.6 | 0.5 | 3.8 | 4.5 | 4.7 | 0.8 | 0.9 | 1.2 |

EOp in the table represents average molar number of ethylene oxide added.

Example 2

3 % by weight of tallow soap, zeolite A in an amount as specified in Table 4, an oil-absorbing carrier having properties as specified in Table 3 (wherein the oil-absorbing capacity was determined according to JIS K 6220) in an amount as specified in Table 4, the balance of sodium carbonate, 3% by weight of sodium polyacrylate and 0.5% by weight of a fluorescent dye were placed in a batch kneader (Bench Kneader PNV-1 of Irie Shokai). A liquid nonionic surfactant in an amount as specified in Table 4 was gradually introduced thereinto and then 2% by weight of molten polyethylene glycol having an average molecular weight of 6000 was added thereto. Further 0.5% by weight of an enzyme, 0.3% by weight of a perfume, 5% by weight of zeolite A and 2% by weight of water were added thereto and mixed together to obtain a final detergent product, having 11 composition as specified in Table 4.

The oozing, powder fluidity, caking, and change in solubility with time of the detergent product were tested by the same methods as those of Example 1.

The results are given in Table 4.

TABLE 3

| Kind | $SiO_2$ content (wt. %) | Oil-absorbing capacity (ml/100 g) | pH of 5% dispersion | Amount dissolved in 2% aqueous NaOH solution (%) |
|---|---|---|---|---|
| PERLITE (DICALITE, PERLITE 4159, DICALITE ORIENT, Co., Ltd.) | 72.7 | 165 | 7.8 | 0.01 |
| Na-Mordenite (HSZ-640NAA, Tosoh Corp.) | 87.5 | 110 | 10.7 | 0.12 |
| TOKUSIL NR (Tokuyama Soda Co., Ltd.) | 94 | 280 | 5.8 | 2.35 |
| FLORITE RN (Tokuyama Soda Co., Ltd.) | 61 | 380 | 8.1 | 2.18 |

The quantity of the oil-absorbing carrier dissolved in a 2% aqueous NaOH solution was determined by dispersing 10 g of the oil-absorbing carrier in 100 ml of a 2% aqueous NaOH solution, stirring the dispersion for 16 h while the temperature was kept at 25° C. and dertermining $SiO_2$ in the filtrate by colorimetric determination [as for the colorimetric determination, refer to Yukagaku, Vol. 25, p. 156 (1976)]. Namely, the quantity of the oil-absorbing carrier dissolved in the aqueous NaOH solution calculated from the $SiO_2$ content of the oil-absorbing carrier previously determined by elementary analysis was calculated.

TABLE 4

| | Composition (wt. %) | Invention product 1 | 2 | Comparative 3 | 4 | Invention product 5 | 6 | Comparative 7 |
|---|---|---|---|---|---|---|---|---|
| Component (a) | polyoxyethylene synthetic alcohol ($C_{12}$ to $C_{14}$) ether (m.p. 15° C., EOp = 7, HLB 9.8) | 24 | 24 | 24 | 24 | | 15 | 15 |
| | polyoxyethylene dodecyl ether (m.p. 15° C., EOp = 8, HLB 10.14) | | | | | 20 | | |
| Component (b) | Zeolite A | 27 | 27 | 27 | 27 | 45 | 45 | 55 |
| Component (c) | PERLITE ® | 20 | | | | 15 | | 3 |
| | Na—Mordenite | | 16 | | | | 22 | |
| | TOKUSIL NR ® | | | 10 | | | | |
| | FLORITE RN ® | | | | 7 | | | |
| Evaluation results | oozing | A–B | A–B | A–B | A–B | A–B | A–B | B |
| | fluidity (sec) | 8.0 | 8.1 | 8.2 | 8.1 | 8.2 | 8.1 | 9.1 |
| | caking (undersize wt. %) | 100 | 100 | 100 | 100 | 100 | 100 | 72 |
| | solubility change upon storage [filtration residue (%)] | 0.2 | 0.1 | 3.4 | 3.5 | 0.2 | 0.2 | 0.3 |

EOp in the table represents average molar number of ethylene oxide added.

Example 3

(1) Synthesis of amorphous aluminosilicate:

700 g of an aqueous sodium silicate solution ($Na_2O$: 2.71% by weight, $SiO_2$:8.29% by weight and $SiO_2/Na_2O$ molar ratio: 3.15) was heated to 60° C. and 1010 g of an aqueous sodium aluminate solution ($Na_2O$:1.63% by weight, $Al_2O_3$:2.26% by weight and $Na_2O/Al_2O_3$ molar ratio: 1.18) was added to the solution under stirring at 1500 rpm. After the completion of the addition, the solution was heat-treated at that temperature for 15 min and the resulting wet cake was dried at 110° C. and pulverized to obtain 100 g of fine powder of the aluminosilicate which was found to be amorphous by X-ray crystallography. The composition of the resulting amorphous aluminosilicate was: $Na_2O:SiO_2:Al_2O_3$=29.4:44.5:26.1. The resulting amorphous aluminosilicate had an ion-exchange capacity of 121 $CaCO_3$ mg/g, an oil-absorbing capacity of 225 ml/100 g, and a solubility in a 2% aqueous NaOH solution of 0.01 g, and the pH of a 5% dispersion thereof was 11.2.

(2) Preparation of detergent:

A detergent was prepared from the amorphous aluminosilicate as will be described below.

3 % by weight of tallow soap, zeolite A in an amount as specified in Table 5, an oil-absorbing carrier (amorphous aluminosilicate) in an amount as specified in Table 5, the balance of sodium carbonate, 1% by weight of No. 2 sodium silicate, 2% by weight of sodium polyacrylate and 0.5% by weight of a fluorescent dye were placed in a batch kneader (Bench Kneader PNV-1 of Irie Shokai). A liquid nonionic surfactant in an amount as specified in Table 5 was slowly introduced thereinto and then 2% by weight of molten polyethylene glycol was added thereto, Further 0.5% by weight of an enzyme, 0.5% by weight of a perfume, 5% by weight of zeolite A and 2% by weight of water were added thereto and mixed together to obtain a final detergent product having a composition as specified in Table 5.

The oozing, powder fluidity, caking, and solubility change upon storage of the detergent product were rested by the same methods as those of Example 1.

The results are given in Table 5.

TABLE 5

| | Invention product 1 | 2 | 3 | Comparative 1 | 2 | 3 |
|---|---|---|---|---|---|---|
| Composition (wt. %) | | | | | | |
| polyoxyethylene synthetic alcohol ($C_{12}$ to $C_{14}$) ether (m.p. 15° C., EOp = 7, HLB 9.8) | 25 | 20 | 15 | 15 | 20 | 20 |
| zeolite A | 20 | 25 | 50 | 55 | 30 | 30 |
| amorphous aluminosilicate | 20 | 10 | 6 | 3 | | |
| amorphous silica (Tokusil NR mfd. by Tokuyama Soda and having oil-absorbing capacity of 280 ml/100 g and solubility in 2% aqueous NaOH solution of 2.35 g) | | | | | 8 | |
| amorphous silica (Florite RN mfd. by Tokuyama Soda and having oil-absorbing capacity of 280 ml/100 g and solubility in 2% aqueous NaOH solution of 2.18 g) | | | | | | 5 |
| Evaluation results | | | | | | |
| oozing | A–B | A–B | A–B | B | A–B | B |
| fluidity (sec) | 8.2 | 8.0 | 8.3 | 9.2 | 8.2 | 8.2 |
| caking [undersize wt. %] | 100 | 100 | 100 | 63 | 100 | 100 |

TABLE 5-continued

| | Invention product | | | Comparative | | |
|---|---|---|---|---|---|---|
| | 1 | 2 | 3 | 1 | 2 | 3 |
| solubility change upon storage [filtration residue (%)] | 0.3 | 0.2 | 0.3 | 0.2 | 5.0 | 3.6 |

Note)
EOp in the Table represents the average molar number of ethylene oxide added.

Example 4

(1) Synthesis of amorphous aluminosilicate:

100 parts by weight of No. 3 water glass (prepared by adding 150 parts by weight of ion-exchanged water to 100 parts by weight of commercially available No. 3 waterglass) was added dropwise to 800 parts by weight of an aqueous sodium aluminate solution (prepared by adding 2000 parts by weight of ion-exchanged water to 100 parts by weight of an aqueous sodium aluminate solution having $Na_2O:Al_2O_3:H_2O$ weight ratio of 20.3:28.2:51.5) over 20 min. After the reaction was conducted for 10 min, and the reaction mixture was heated at 100° C. and aged for 10 min. The resulting cake was taken by filtration and it was washed until the pH of the filtrate reached 12.0, dried at 100° C. for 11 h and finely pulverized with a pulverizer to obtain an amorphous aluminosilicate. The composition of the resulting amorphous aluminosilicate was: $Na_2O:SiO_2:Al_2O_3$= 19.59:47.39:33.03. The resulting amorphous aluminosilicate had an ion-exchange capacity of 115 $CaCO_3$ mg/g and an oil-absorbing capacity of 250 ml/100 g, and the pH of a 5% dispersion thereof was 11.2 (solubility in a 2% NaOH solution was 0.02 g).

(2) A detergent having the following composition was prepared from the amorphous aluminosilicate synthesized as described above.

Detergent composition:

polyoxyethylene dodecyl ether
(average molar number of ethylene oxide added: 8, melting point:

| | |
|---|---|
| 15° C., HLB: 10.14) | 20% by wt. |
| coconut oil fatty acid diethanolamide | 3 |
| tallow soap | 2 |
| zeolite A (average particle diameter: 4μ) | 40 |
| amorphous aluminosilicate synthesized as above | 8 |
| sodium carbonate (average particle diameter: 290μ) | 10 |
| No. 2 sodium silicate | 5 |
| Glauber's salt | 4.7 |
| polyethylene glycol (MW: 6000) | 2 |
| carboxymethylcellulose | 2 |
| sodium polyacrylate (MW: 8000) | 2 |
| enzyme | 0.5 |
| perfume | 0.3 |
| fluorescent dye | 0.5 |

The above-described powdery starting materials [tallow soap, zeolite A (in an amount corresponding to 25% by weight), amorphous aluminosilicate, sodium carbonate (average particle diameter: 290 μ), No. 2 sodium silicate, Glauber's salt, carboxymethylcellulose, sodium polyacrylate and fluororescent dye] were placed in a batch kneader (Bench Kneader PNV-1 mfd. by Irie Shokai). Polyoxyethylene dodecyl ether and coconut oil fatty acid diethanolamide were gradually introduced thereinto and then molten polyethylene glycol was added thereto to obtain a powdery detergent base having an average particle diameter of 402 μ. The enzyme, perfume and a small amount (corresponding to 15% by weight) of zeolite A were added thereto and mixed together to obtain a final detergent product having a composition described above and a bulk density of 0.75 g/ml.

The detergent was evaluated in the same manner as that of Example 1 to find that the oozing was A-B, the fluidity was 8.0 sec, the caking was 100% and the change in solubility with time was 0.2%.

Example 5

3% by weight of tallow soap, zeolite 4A [component (b)] in an amount as specified in Table 6, an oil-absorbing carrier [component (c)] in an amount as specified in Table 6, the balance of sodium carbonate, 3% by weight of sodium polyacrylate and 0.5% by weight of a fluorescent dye were placed in a batch kneader (Bench Kneader PNV-1 of Irie Shokai). A liquid nonionic surfactant in an amount as specified in Table 6 was gradually introduced thereinto and then 2% by weight of molten polyethylene glycol was added thereto to obtain a powdery detergent base having an average particle diameter of 385 μ.0.5% by weight of an enzyme, 0.3% by weight of a perfume and 5% by weight of zeolite 4A were added thereto and mixed together to obtain a nonionic powdery detergent having a bulk density of 0.7 g/ml.

1500 g of the nonionic powdery detergent prepared as described above was placed in a paper container (14.8 cm width×8.7 cm length×16 cm height) of which inner walls are laminated with a polymer specified in Table 6 to form a film having a thickness of about 25 μ. An acrylic resin plate (15 g) and a lead plate (250 g) (total weight: 265 g) were placed thereon and they were left to stand in a thermohygrostatic chamber at 30° C. and 80% RH for 10 days.

After the test, the detergent was carefully removed from the container and the extent of adhesion of the nonionic powdery detergent to the inner wall of the container was classified into the following groups. The results are given in Table 6.

o: no adhesion of the powdery detergent was observed at all,

Δ: slight adhesion of the powdery detergent was observed, and x: the adhesion of the powdery detergent to the whole surface was observed.

TABLE 6

| | Composition (wt. %) | Invention product 1 | Invention product 2 |
|---|---|---|---|
| Component (a) | polyoxyethylene dodecyl ether (average molar number of ethylene oxide added: 8, m.p.: 15° C., HLB: 10.14) | 20 | 20 |
| Component (b) | Zeolite 4A (average particle diameter 3μ) | 30 | 20 |
| Component (c) | TOKUSIL AL-1 (Tokuyama Soda Co., Ltd.) (oil-absorbing capacity: 255 ml/100 g, $SiO_2$ content: 94%) | 10 | 10.5 |
| Container | laminating polymer (lamination of paper having basis weight of 640 g/m$^2$) | PE* | PP* |
| | solubility parameter determined by Fedors method (cal/cm$^3$)$^{1/2}$ | 8.56 | 8.02 |
| Results | adhesion to the wall surface | o | o |

*PE: polyethylene PP: polypropylene

We claim:

1. A nonionic powder detergent composition comprising (a) 12 to 35% by weight of a polyoxyethylene alkyl ether having 10 to 20 carbon atoms and an average molar number of added ethylene oxide of 5 to 15, (b) 10 to 60% by weight of a crystalline aluminosilicate, (c) 5 to 20% by weight of an amorphous oil-absorbing carrier selected from the group consisting of silica and aluminosilicates (c-1) containing at least 30% by weight of silicon in terms of $SiO_2$, (c-2) having an oil-absorbing capacity of at least 80 ml/100 g, said carrier (c-3) giving a dispersion with a pH value of at least 9 or being soluble in a 2% aqueous NaOH solution in an amount of 0.5 g or less and (d) below 5% by weight of sodium silicate, obtained by a process comprising the steps of:

mixing a portion of (b) said crystalline aluminosilicate, (c) said amorphous oil-absorbing carrier and optionally (d) said sodium silicate;

adding (a) said liquid nonionic surfactant gradually during said mixing step, to obtain a homogenous mixture of (a), (b), (c) and optionally (d); and adding the remaining of (b) crystalline aluminosilicate to obtain said nonionic powder detergent.

2. The nonionic powdery detergent composition according to claim 1, further comprising 5 to 35% by weight of sodium carbonate.

3. The nonionic powdery detergent composition according to claim 1, wherein the amorphous oil-absorbing carrier is amorphous silica.

4. The nonionic powdery detergent composition according to claim 1, which comprises 12 to 35 wt. % of (a), 20 to 60 wt. % of (b) and 5 to 20 wt. % of (c) an oil-absorbing carrier (c-1) containing at least 40 wt. % of silicon in terms of $SiO_2$ (c-2) having an oil-absorbing capacity of at least 150 ml/100 g, said carrier (c-3) giving a dispersion with a pH value of at least 9.

5. The nonionic powdery detergent composition according to claim 1, wherein the amorphous oil-absorbing carrier is an amorphous aluminosilicate.

6. The nonionic powdery detergent composition according to claim 5, wherein the amorphous aluminosilicate is one represented by the following general formula (1):

$$a(M_2O).Al_2O_3.b(SiO_2).c(H_2O) \quad (1)$$

wherein M represents an alkali metal atom and a, b and c each represent the molar number of the respective components which are as follows:

$$0.7 \leqq a \leqq 2.0,\ 0.8 \leqq b < 4 \text{ and}$$

c is an arbitrary positive number.

7. The nonionic powdery detergent product comprising a nonionic powdery detergent composition according to claim 1, packed in a container made of converted paper laminated with a polymer having a solubility parameter value in the range of 7.5 to 11.5 [cal/cm$^3$]$^{1/2}$ and lower than the HLB value of the nonionic surfactant used, and selected from the group consisting of polyethylene and polypropylene.

8. The nonionic powdery detergent composition according to claim 1, further comprising 1 to 5% by weight of a polyethylene glycol having a molecular weight of 4000 to 20000.

9. The nonionic powdery detergent composition according to claim 1, which comprises 12 to 35 wt. % of (a), 20 to 60 wt. % of (b) and 5 to 20 wt. % of (c) an oil-absorbing carrier (c-1) containing at least 40 wt. % of silicon in terms of $SiO_2$, (c-2) having an oil-absorbing capacity of at least 80 ml/100 g, said carrier (c-3) being soluble in a 2% NaOH solution in an amount of 0.5 g or less.

10. The nonionic powdery detergent composition according to claim 1, which is substantially free from any phosphate builder.

11. The nonionic powdery detergent composition according to claim 1, which has a bulk density of 0.6 to 1.2 g/cm$^3$ and an average particle diameter of 200 to 1000 μ.

12. The nonionic powder detergent composition according to claim 1, which comprises 12 to 35 wt. % of (a), 20 to 60 wt. % of (b) and 5 to 20 wt. % of (c) a non-crystalline aluminosilicate (c-2) having an oil-absorbing capacity of at least 200 ml/100 g, said carrier (c-3) being soluble in a 2% aqueous NaOH solution in an amount of 0.05 g or less.

13. The non-ionic powder detergent according to claim 1, wherein said (b) crystalline aluminosilicate is represented by the following formula (3):

$$x(M_2O)\cdot Al_2O_3\cdot y(SiO_2)\cdot w(H_2O) \quad (3)$$

wherein M represents an alkali metal atom and x, y and w each represent a molar number of the respective components which are as follows:

$$0.7 \leqq x \leqq 1.5;\ 0.8 \leqq y \leqq 6; \text{ and}$$

w is an arbitrary positive number.

14. A process for producing a nonionic powder detergent composition, which comprises the steps of mixing (b) a crystalline aluminosilicate with (c) an oil-absorbing carrier, while adding to or spraying onto the mixture (a) a liquid nonionic surfactant gradually to obtain a homogeneous mixture of (a), (b) and (c) and then adding to the mixture further crystalline aluminosilicate to obtain a powder detergent composition.

15. A nonionic powder detergent composition comprising (a) 12 to 35% by weight of a polyoxyethylene alkyl ether having 10 to 20 carbon atoms, an average molar number of added ethylene oxide of 5 to 15 and a melting point of not higher than 40° C., (b) 10 to 60% by weight of a crystalline aluminosilicate, (c) 5 to 20% by weight of an amorphous oil-absorbing carrier selected from the group consisting of silica and aluminosilicates (c-1) containing at least 30% by weight of silicon in terms of $SiO_2$, (c-2) having an oil-absorbing capacity of at least 80 ml/100 g, said carrier (c-3) giving a dispersion with a pH value of at least 9 or being soluble in a 2% aqueous NaOH solution in an amount of 0.5 g or less and (d) below 5% by weight of sodium silicate, obtained by a process comprising the steps of:

mixing a portion of (b) said crystalline aluminosilicate, (c) said amorphous oil-absorbing carrier and optionally (d) said sodium silicate;

adding (a) said liquid nonionic surfactant gradually during said mixing step, to obtain a homogenous mixture of (a), (b), (c) and (d); and adding the remaining of (b) crystalline aluminosilicate to obtain said nonionic powder detergent.

16. A nonionic powder detergent composition comprising (a) 12 to 35% by weight of a liquid nonionic surfactant, (b) 10 to 60% by weight of a crystalline aluminosilicate, (c) 5 to 20% by weight of an amorphous oil-absorbing carrier selected from the group consisting of silica and aluminosilicates (c-1) containing at least 30% by weight of silicon in terms of $SiO_2$, (c-2) having an oil-absorbing capacity of at least 80 ml/100 g, said carrier (c-3) giving a dispersion with a pH value of at least 9 or being soluble in a 2% aqueous NaOH solution in an amount of 0.5 g or less and (d) below 5% by weight of sodium silicate obtained by a process comprising the steps of:

mixing a portion of (b) said crystalline aluminosilicate, (c) said amorphous oil-absorbing carrier and optionally (d) said sodium silicate;

adding (a) said liquid nonionic surfactant gradually during said mixing step, to obtain a homogenous mixture of (a), (b), (c) and optionally (d); and adding the remaining of optionally (b) crystalline aluminosilicate to obtain said nonionic powder detergent.

* * * * *